US006162012A

United States Patent [19]

Tuckey et al.

[11] Patent Number: 6,162,012

[45] Date of Patent: Dec. 19, 2000

[54] FORCE BALANCED LATERAL CHANNEL FUEL PUMP

[75] Inventors: Charles H. Tuckey, Sand Point; Edward J. Talaski, Caro, both of Mich.

[73] Assignee: Walbro Corporation, Cass City, Mich.

[21] Appl. No.: 09/371,236

[22] Filed: Aug. 10, 1999

Related U.S. Application Data

[63] Continuation-in-part of application No. 08/963,046, Nov. 3, 1997, abandoned.

[51] Int. Cl.[7] ..... F04D 5/00

[52] U.S. Cl. ..... 415/55.1; 415/55.2

[58] Field of Search ..... 415/55.1, 55.2, 415/55.3, 55.4

[56] References Cited

U.S. PATENT DOCUMENTS

| | | | |
|---|---|---|---|
| 3,871,797 | 3/1975 | Igarashi et al. . | |
| 4,492,515 | 1/1985 | Watanabe et al. . | |
| 4,556,363 | 12/1985 | Watanabe et al. . | |
| 4,678,395 | 7/1987 | Schweinfurter . | |
| 4,715,777 | 12/1987 | Tuckey | 415/55.1 |
| 5,413,457 | 5/1995 | Tuckey | 415/55.6 |
| 5,472,321 | 12/1995 | Radermacher . | |
| 5,580,213 | 12/1996 | Woodward et al. | 415/55.1 |
| 5,596,970 | 1/1997 | Schoenberg | 123/497 |
| 5,702,229 | 12/1997 | Moss | 415/55.4 |

FOREIGN PATENT DOCUMENTS

| | | |
|---|---|---|
| 1260039 | 3/1961 | France . |
| 2105121 | 8/1972 | Germany . |

*Primary Examiner*—Edward K. Look
*Assistant Examiner*—Rhonda Barton
*Attorney, Agent, or Firm*—Reising, Ethington, Barnes, Kisselle, Learman & McCulloch, P.C.

[57] ABSTRACT

A lateral channel fuel pump with a stator having a pumping channel and a second channel each of which cooperates with vanes in a rotor driven to rotate by an electric motor to generate pressure within both the pumping channel and the second channel. The second channel and preferably cavities communicating with it are disposed so that the fuel pressure generated within the channel and any cavities produces forces which, when combined with the forces generated in the pumping channel, provide net forces which are substantially equal or uniform across the lower face of the rotor so that the forces produced by outlet fuel acting across the upper face of the rotor do not tend to cock or tilt the rotor relative to the stator. Further, the second channel and any cavities increase the total force acting upwardly on the lower face to reduce the magnitude of the net force on the rotor urging the rotor towards the stator and hence, to reduce the frictional forces between the rotor and stator. Alternatively, the pump may have dual pumping channels about 180° out of phase with each other to balance the forces across the rotor. Reducing the frictional forces between the rotor and the stator and balancing the forces across the rotor so that it is not cocked or tilted relative to the stator increases the efficiency of the pump, decreases the wear between the rotor and the stator to increase the life of the fuel pump, and increases the output capacity and pressure generated by the pump.

32 Claims, 6 Drawing Sheets

FORCE BALANCED LATERAL CHANNEL FUEL PUMP

REFERENCE TO APPLICATION

This application is a continuation-in-part of patent application U.S. Ser. No. 08/963,046 filed on Nov. 3, 1997 and abandoned in favor of this application.

FIELD OF THE INVENTION

This invention relates generally to fuel pumps and more particularly to a side channel turbine type fuel pump.

BACKGROUND OF THE INVENTION

Lateral or side channel fuel pumps, such as that disclosed in U.S. Pat. No. 4,715,777, may be used to supply fuel to an operating engine. These pumps utilize a stationary body having a flat face with a circumferentially extending groove or channel formed in the face and communicating with a fuel inlet. A rotor with vanes communicating with the channel is positioned to rotate closely adjacent to the stationary body to move fuel from the inlet to an outlet from the channel with an increase in pressure taking place between the inlet and outlet. The outlet of the channel discharges fuel under pressure which produces forces acting generally uniformly on an upper face of the rotor urging the rotor towards the stator and generating a relatively high level of friction between the rotor and the stator body which greatly limits the output pressure of the pump. Because the pressure of fuel in the channel increases from its inlet to its outlet, fuel in the channel produces a force tending to separate the rotor and stator which varies as a function of the fuel pressure from the inlet to the outlet of the channel. The substantially uniform force across the entire upper face of the rotor and the varied force generated in the channel produces a varied net force across the rotor which tends to cock or tilt the rotor relative to the stator which causes uneven wear of the rotor and stator, decreases the service life of the pump and reduces the efficiency of the pump. Typically, lateral channel turbine pumps are limited to output fuel pressures below 10 psi because of the friction generated between the rotor and the stationary body.

SUMMARY OF THE INVENTION

A lateral channel fuel pump with a stator having a pumping channel and a second channel each of which cooperates with vanes in a rotor driven to rotate by an electric motor to generate pressure within both the pumping channel and the second channel. The second channel and preferably cavities communicating with it are disposed so that the fuel pressure generated within the second channel and any cavities produces forces which, when combined with the forces generated in the pumping channel, provide net forces which are substantially equal across the face of the rotor to significantly reduce or even substantially eliminate the tendency to cock or tilt the rotor relative to the stator. Further, the second channel and any cavities increase the magnitude of the forces acting upwardly on the lower face of the rotor to significantly reduce or substantially completely offset the magnitude of the net force on the rotor urging the rotor towards the stator and hence, to greatly reduce the frictional forces between the rotor and stator. Reducing the frictional forces between the rotor and the stator and balancing the forces across the rotor so that it is not cocked or tilted relative to the stator increases the efficiency of the pump, decreases the wear between the rotor and the stator to increase the life of the fuel pump, and increases the output pressure generated by the pump.

The second channel may be formed radially inwardly or radially outwardly of the pumping channel. In one embodiment separate cavities may be formed in the stator in communication with the second channel to be filled with liquid fuel under pressure in use to strategically locate and vary the magnitude of forces on the rotor to balance and oppose the forces tending to cock or tilt the rotor and to reduce the frictional forces between the rotor and stator.

In another embodiment the pump has two separate pumping channels which are circumferentially spaced or spaced out of phase to produce forces acting on the rotor which tend to balance it and reduce the friction forces between the rotor and the stator.

Objects, features and advantages of this invention include providing a lateral channel fuel pump which has a force balanced rotor, reduces friction between the rotor and stator, reduces wear of the rotor and stator, provides an increased output pressure, is of relatively simple design and economical manufacture and assembly, is efficient, durable and reliable and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
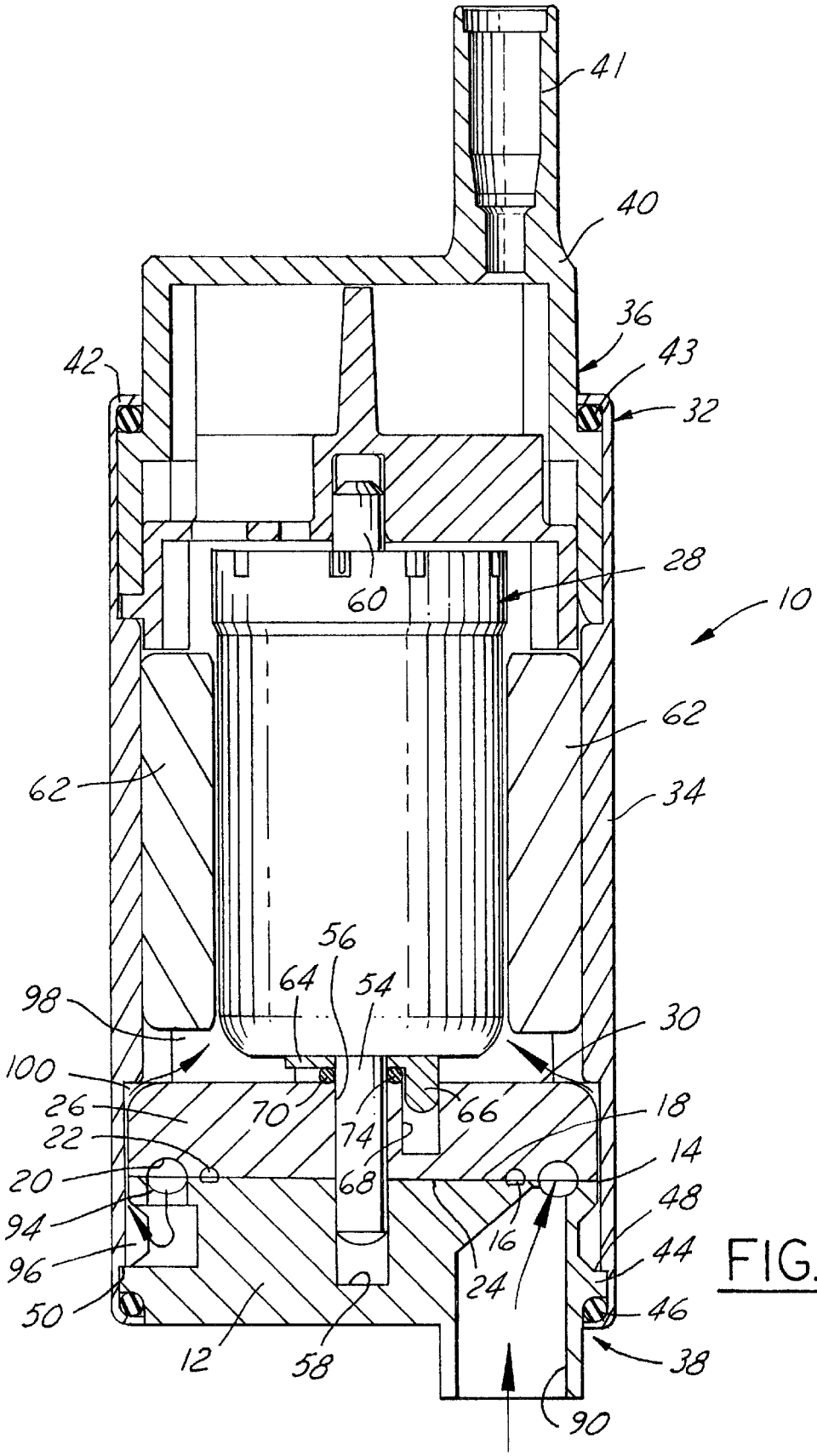
FIG. 1 is a sectional view of a first fuel pump embodying the invention.

Referring in more detail to the drawings, FIG. 1 shows an electric motor turbine type fuel pump 10 with a stator 12 having a fuel pumping channel 14 and a second channel 16 each formed in an upper face 18 of the stator 12 and in communication with a separate set of vanes 20, 22 formed in a lower face 24 of a rotor 26 to generate pressure within the pumping channel 14 and the second channel 16 when the rotor 26 is driven to rotate by an electric motor 28 of the fuel pump 10. The second channel 16 is disposed so that the fuel pressure generated within the second channel 16 balances the forces across the rotor 26 generated by the varying fuel pressure within the pumping channel 14 and the outlet fuel pressure acting on the upper face 30 of the rotor 26. Balancing) the forces across the rotor 26 reduces skewing or tilting of the rotor and reducing the net force urging the rotor toward the stator reduces the frictional forces or drag between the rotor 26 and stator 12 as the rotor 26 is driven to rotate to thereby increase the efficiency of the pump 10, decrease the wear of the rotor 26 and stator 12, increase the life of the fuel pump 10 and increase the output pressure generated by the pump 10 in use.

The fuel pump 10 has a housing 32 with a tubular outer shell 34 with a pair of open ends 36, 38 one of which receives an outlet end cap 40 containing the fuel pump outlet 41 and an O-ring 43 abutting an inwardly extending rim 42 to provide a seal adjacent the end cap 40. The other end 38 of the shell 34 is rolled around a circular and radially extending flange 44 of the stator 12 with a sealing member 46 such as an O-ring received between them. The upper edge 48 of the flange 44 abuts a shoulder 50 of the shell 34 to retain the stator 12. An armature assembly 52 is journalled for rotation within the housing 32 by a shaft 54 extending through a cylindrical bore 56 in the rotor 26 and received within a hollow blind hole 58 of the stator 12. At its other end, the armature assembly 52 is journalled in the outlet end cap 40 by a central shaft 60. Armature magnets 62 are received adjacent the armature 52 within the shell 34.

Figure 4:
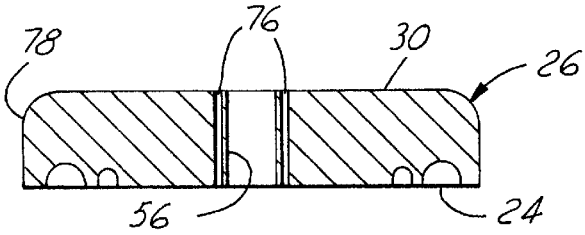
FIG. 4 is a sectional view of the rotor of the fuel pump of FIG. 1.
Figure 5:
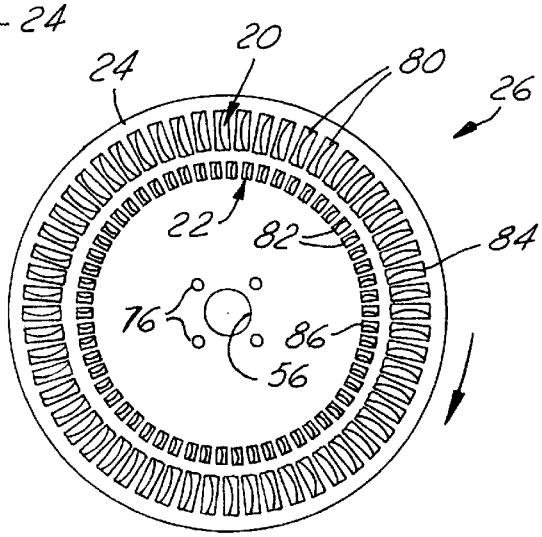
FIG. 5 is a bottom view of the rotor of the fuel pump of FIG. 1.

The rotor 26 is coupled with the shaft 54 for co-rotation therewith by a clip 64 having several fingers 66 received within complementary shaped recesses 68 in the rotor 26. An O-ring 70 may be disposed on the shaft 54 to act as a spacer and/or a spring between the armature 52 and the rotor 26. Alternatively, to reduce fuel leakage between the rotor 26 and stator 12, the rotor 26 may be urged toward the stator 12 by a spider spring disc (not shown) having legs pressing against the rotor 26 and a central portion backed by the clip 64. As shown in FIGS. 4 and 5, several small fuel inlet passages 76 are formed through the rotor 26 and communicate fuel downstream of the rotor 26 with the second channel 16. As the rotor 26 is being driven to rotate, the fuel on top of the rotor 26 and adjacent the armature shaft 54 is swirling in the fuel pump housing 32 and the centrifugal force therein tends to move dirt and other contaminants towards the outer edge 78 or periphery of the rotor 26 so that "cleaner" fuel enters the inlet passages 76 to reduce the contaminants received between the rotor 26 and stator 12. A first set of vanes 20 formed to open into the lower, flat face 24 of the rotor 26 is constructed to generate pressure within the pumping channel 14 as the rotor 26 rotates. A second set of vanes 22 formed radially inwardly of the first set of vanes 20 and opening into the flat face 24 is constructed to generate pressure within the second channel 16 as the rotor 26 rotates. Each set of vanes 20, 22 comprises a plurality of individual pockets 80, 82 each with a vane 84, 86 disposed along a circular path constructed to be complementarily shaped to the corresponding channel 14, 16. Preferably each vane 84, 86 is inclined to the axis of rotation of the rotor at an acute included angle so that relative to its direction of rotation its upper edge trails its lower edge at the rotor face 24.

Figure 2:
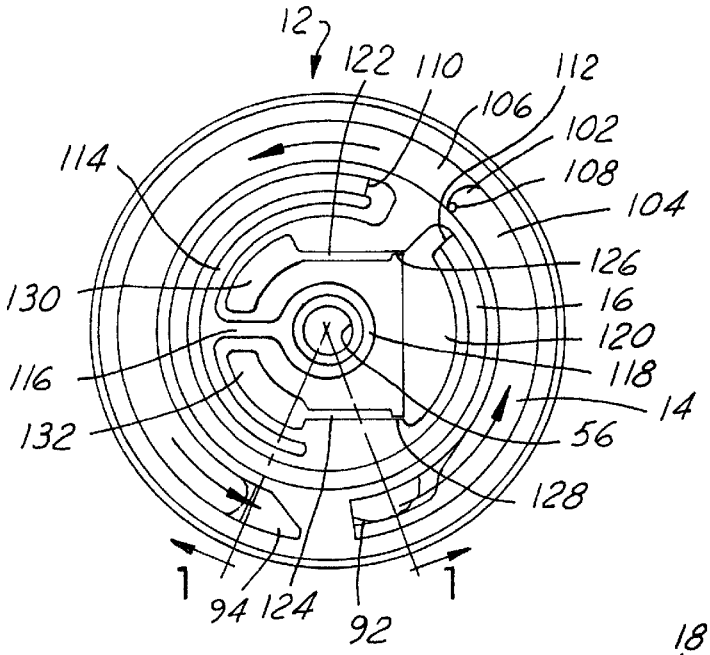
FIG. 2 is a top view of the stator of the fuel pump of FIG. 1.
Figure 3:
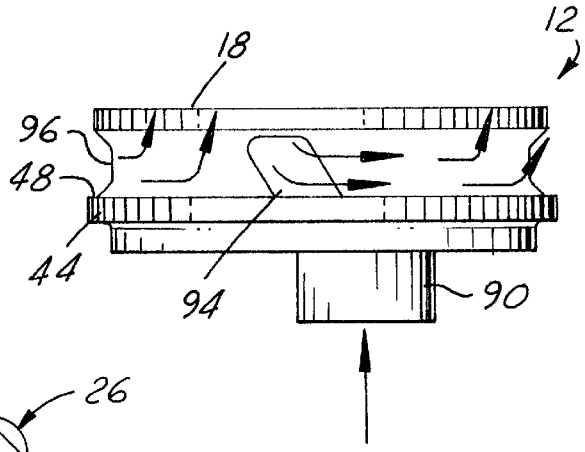
FIG. 3 is a side view of the stator of the fuel pump of FIG. 1.

As shown in FIGS. 1 and 2, the stator 12 has an inlet passage 90 and an inlet port 92 through which fuel is drawn into the pumping channel 14. An outlet port 94 of the pumping channel 14 empties into a circumferentially extending groove 96 formed in the edge of the stator 12 which communicates with a chamber 98 defined in the housing 32 downstream of the rotor 26 through a clearance gap 100 between the shell 34 and both the upper portion of the edge of the stator 12 and the rotor 26.

As shown in FIG. 2, both the pumping channel 14 and second channel 16 open into the upper face 18 of the stator 12, are generally circular preferably spanning about 330° to 350°, and are spaced radially inwardly of the outer edge of the stator 12 with the second channel 16 preferably spaced radially inwardly of the pumping channel 14. Fuel flows counterclockwise (as viewed in FIG. 2) through the pumping channel 14 from the inlet 92 to the outlet 94. A transition section or ramp 102 in the pumping channel 14 merges an upstream portion 104 with a downstream portion 106 which has a smaller cross-sectional area than the upstream portion 104. A purge port 108 formed in the pumping channel 14 bleeds off fuel vapor at the start up of the pump to quickly prime the pump 10 and permits any fuel vapor to escape from the pumping channel 14 during operation of the fuel pump. The purge port 108 is sized and arranged so that it does not significantly affect the overall efficiency of the fuel pump 10. The decrease in cross-sectional area within the pumping channel 14 downstream of its inlet 92 is desirable to decrease the drop in pressure of the liquid fuel at the inlet 92 and to compensate for the decrease in volume of fluid in the pumping channel which occurs as fuel vapor is compressed and condensed in the pumping channel and removed through the purge port 108.

An elongate generally arcuate groove 114 opens into the upper face 18 of the stator and has one end in communication with an inlet 110 of the second channel 16 and is disposed radially inwardly of the second channel 16. The groove 114 h as a branch 116 which opens into an annular recess 118 surrounding the bore 56. The second channel 16 communicates with the chamber 98 through the inlet passages 76, the annular recess 118, the branch 116 and the groove 114. A cavity 120 has one end in communication with a downstream end or outlet 112 of the second channel 16 and is disposed generally radially inwardly of the second channel 16. A pair of spaced apart grooves 122, 124 communicate at one end with the cavity 120 through calibrated slots 126, 128 and at their opposite end with separate cavities 130, 132 formed generally between the annular recess 118 and the groove 114 on either side of the branch 116. The slots 126, 128 are constructed and arranged to permit a flow of fuel from the cavity 120 to each of the separate cavities 130, 132 to provide fuel under pressure in the cavities 130, 132 and balance the forces acting across the rotor 26 adjacent those cavities 130, 132. Each of the cavities 120, 130, 132, grooves 114, 116, slots 126, 128 and the recess 118 opens into the upper face 18 of the stator to communicate with the overlying portion of the rotor and are constructed to be filled with liquid fuel to help balance the varying forces across the rotor 26 and to provide a liquid bearing adjacent the rotor 26. The downstream end 112 of the second channel 16 dead ends in the cavity 120 and the cavities 130, 132. The total force produced by each cavity 120, 130, 132, groove 114, 116, slot 126, 128 and recess 118 and acting on the rotor 26 can be varied by changing the surface area of each exposed to the rotor 26 and the pressure of the fuel within each. Further, the area in which this force is applied to the rotor 26 can be changed by moving the location of the cavities 120, 130, 1.32, grooves 114, 116, slots 126, 128 and the recess 118 in the stator 12 all for the purpose of balancing the net forces acting on various areas radially across and circumferentially of the rotor 26.

Operation

For a fuel pump 10 having a nominal 40 psi output pressure, the inlet 92 of the pumping channel 14 will be at a reduced pressure, nominally 0 psi. The outlet 94 of the pumping channel 14 as well as the chamber 98 will be at or slightly above the output pressure of 40 psi of the fuel pump 10 at the outlet 41. Therefore, a significant pressure differential exits across the rotor 26, especially in the area of the inlet 92 where the upper face 30 of the rotor 26 is acted on by liquid fuel in the chamber 98 which is at about 40 psi and the lower face 24 of the rotor 26 in the area adjacent the inlet 92 is at inlet pressure, or about 0 psi. A significantly reduced pressure differential exists; across the rotor 26 in the area adjacent the outlet 94 where the pressure in the pumping channel is approaching 40 psi which is equal to the pressure acting on the upper face 30 of the rotor 26. However, the fuel on the upper face 30 acts on a much greater surface area than does the fuel in the channel 14 and thus, a significantly greater force is produced on the upper face 30 than within the channel 14 even adjacent the outlet 94 of the channel 14. This force on the upper face 30 of the rotor 26 urges the rotor 26 towards the stator 12 and generates significant frictional forces between them and the rotor tends to cock or tilt due to the varying force applied to the lower face 24 of the rotor 26 by the fuel pressure in the pumping channel 14.

To balance the forces across the rotor 26, some of the fuel in the chamber 98, which is generally at 40 psi, flows into the recess 118 through the inlet passages 76 and then flows through passages 116 and 114 to the inlet 110 of the second pumping channel 16. The pressure of the fuel in the second channel 16 is increased from its inlet 110 to its outlet end 112 and hence, the pressure at the outlet end 112 and within the cavity 120 is greater than 40 psi. For ease of description, the half of both the pumping channel 14 and the second channel 16 nearer their respective inlets 92, 110 will be referred to as their "low pressure sections." Likewise, the other half of each channel 14, 16, which is nearer their respective outlets 94, 112 will be referred to as their "high pressure sections" even though, as described above, the "low pressure section" of the second channel 16 may be at a higher pressure than the "high pressure section" of the pumping channel 14.

So designated, circumferentially spacing the inlets 92, 110 and outlets 94, 112 of each channel 14, 16 apart by about 90° to 180°, desirably 110° to 160° and preferably about 130° to 140°, positions the high pressure section of the second channel 16 in the area of the inlet 92 and generally adjacent the low pressure section or inlet portion of the pumping channel 14 where the greatest pressure differential across the rotor 26 exists to balance the forces across the rotor 26 in this area. Also, the low pressure section of the second channel 16 is generally adjacent the high pressure section of the pumping channel 14 where there is less of a pressure differential across the rotor 26, and hence, less force is needed to balance the rotor 26 in this area. Preferably, this positioning of the second channel 16 as well as the construction and arrangement of the cavities, grooves and slots, provides a generally uniform force across the entire lower face 24 of the rotor 26 which is opposed by the substantially uniform force across the upper face 30 of the rotor 26 generated by the outlet fuel acting on that face 30, so that the rotor 26 does not tend to cock or tilt relative to the stator 12. Further, this generally uniform force produced by the fuel pressure in the pumping channel 14, second channel 16, cavities, grooves and slots and applied to the lower face 24 of the rotor 26 is only slightly less or is substantially equal to the total of all forces on the upper face 30 and opposes the forces on the upper face 30 to reduce the frictional forces between the rotor 26 and the stator 12.

Second Embodiment

Figure 6:
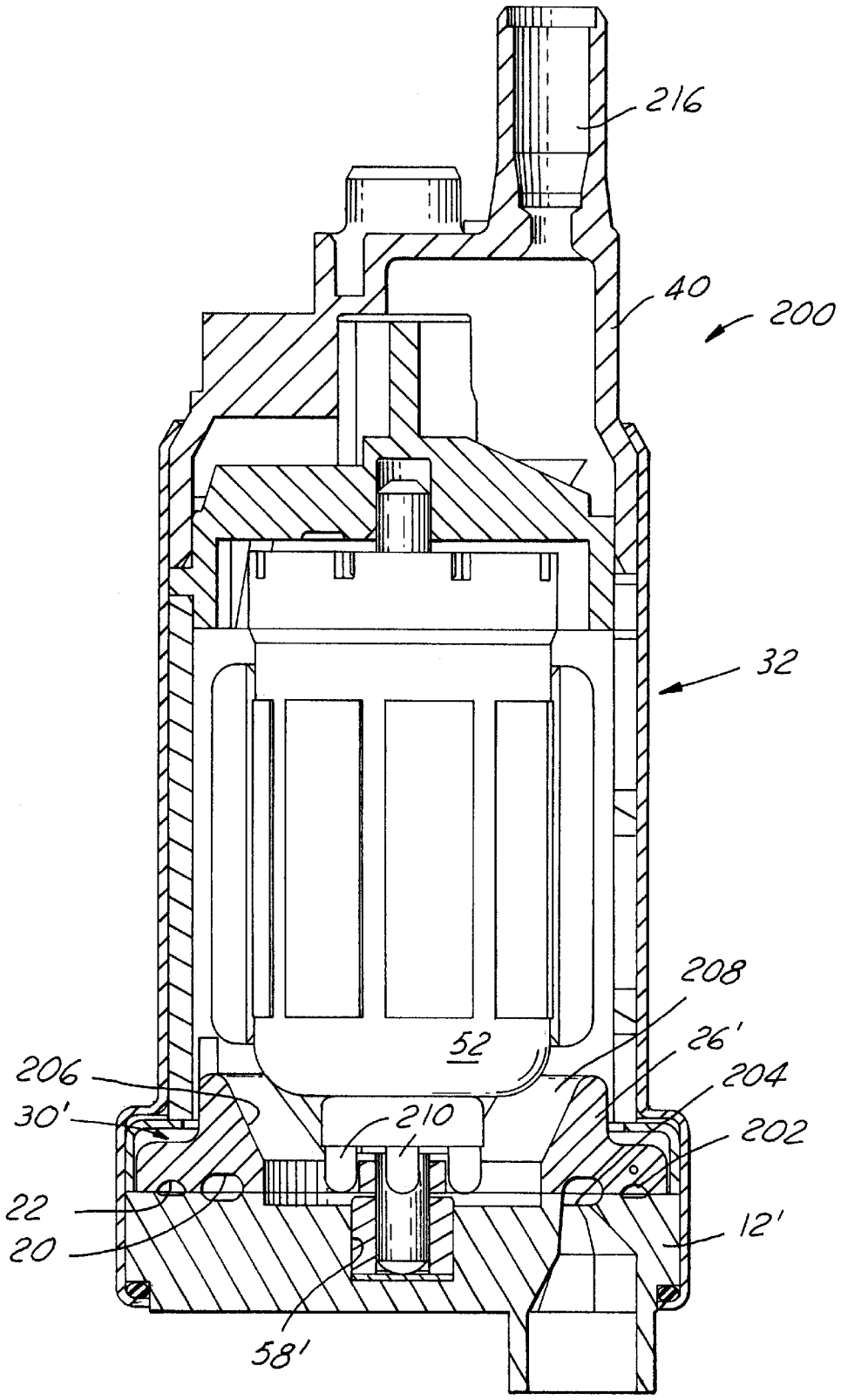
FIG. 6 is a cross sectional view of a second fuel pump embodying the invention.
Figure 7:
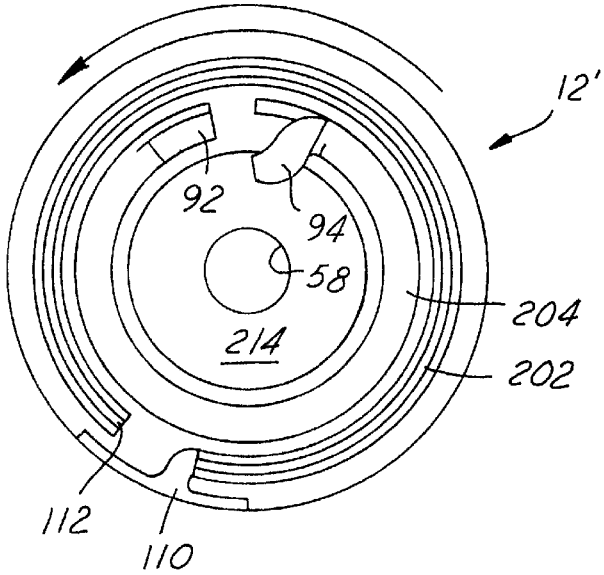
FIG. 7 is a top view of the stator of the fuel pump of FIG. 6.
Figure 8:
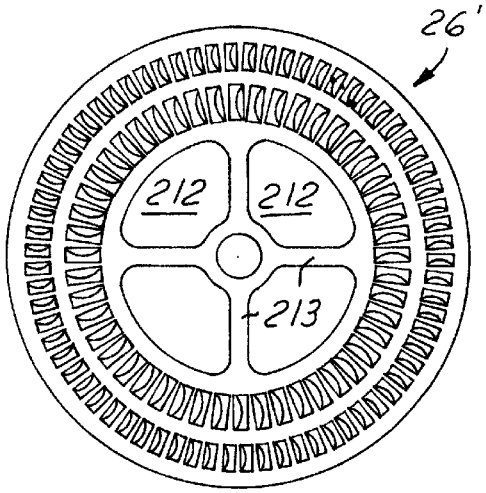
FIG. 8 is a bottom view of the rotor of the fuel pump of FIG. 6.
Figure 10:
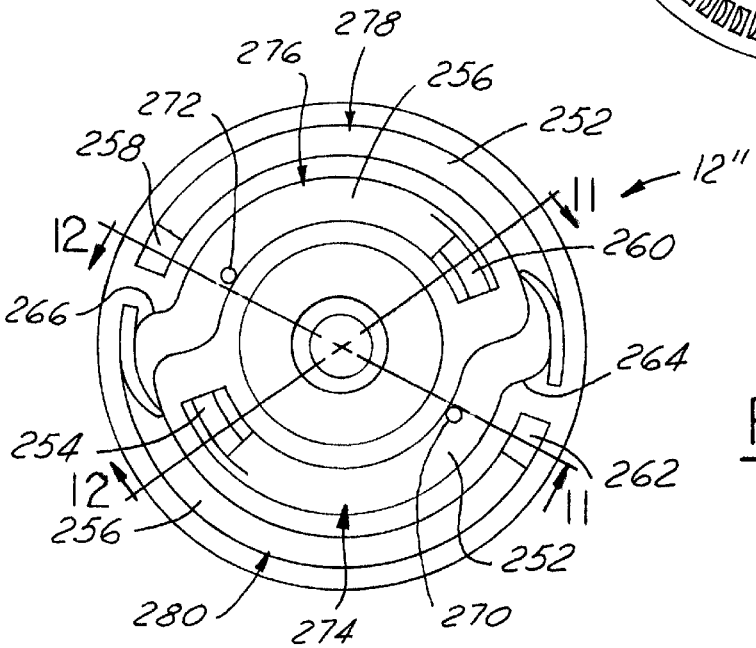
FIG. 10 is a top view of an alternate embodiment of a stator.

FIGS. 6–8 show a second embodiment of a fuel pump 200 wherein the second channel 202 is formed in the stator 12' radially outwardly of the pumping channel 204 and the rotor 26' has its first and second sets of vanes 20, 22 constructed accordingly. The rotor 26' is of a modified construction having a central recess 206 formed in its downstream end 208 and constructed to receive a lower portion of the armature 52 and is coupled to the armature 52 by several pins 210 slidably received in through holes 212 formed in the rotor 26' and engaging spokes 213 defining the holes 212 to drive the rotor.

As shown in FIG. 7, the outlet port 94 of the pumping channel 204 discharges into a central annular cavity 214 formed in the stator 12' generally concentrically aligned with the blind hole 58'. The cavity 214 communicates with the armature assembly 52 through the holes 212 formed in the rotor 26' and thus, fuel discharged from the outlet port 94 flows into the cavity 214, through the rotor 26' and through the fuel pump housing 32 whereupon it is discharged under pressure through an outlet passage 216 defined in the outlet end cap 40. This construction of the rotor reduces the surface area of the upper face 30' of the rotor 26' acted on by liquid fuel, which is at the outlet pressure of the fuel pump 200, to reduce the force acting downwardly on the rotor 26' to decrease the frictional forces between the rotor 26' and the stator 12'. This enables a simpler construction of the stator 12' as the various cavities 120, 130, 132, grooves 114, 116, slots 126, 128 and recess 118 of the first embodiment fuel pump 10 are not formed therein. Rather, the second channel 202 itself has a sufficient surface area and increased pressure to provide the generally uniform force across and circumferentially of the lower face 24' of the rotor 26' so that the rotor 26' is not cocked or tilted relative to the stator 12'. This uniform force across the lower face 24' of the rotor 26' is also sufficient to substantially, if not completely, offset the force on the upper face 30' of the rotor 26, produced by outlet fuel acting thereon, to thereby minimize the frictional forces between the rotor 26' and stator 12'. The second embodiment fuel pump 200 functions in substantially the same manner as the first embodiment fuel pump 10 and hence its operation will not be further described.

Third Embodiment

FIGS. 9–13 illustrate a third embodiment of a fuel pump 250 with a stator 12" having dual pumping channels 252 and 256 circumferentially spaced apart or offset to balance the forces acting on its rotor 282.

The first pumping channel 252 is formed in the stator 12" with its inlet 254 disposed radially inwardly of the second pumping channel 256 and its outlet 25 3 disposed radially outwardly of the second pumping channel 256. A curved transitional section 264 of the first pumping channel 252 crosses between the inlet 260 and outlet 262 of the second pumping channel 256. Thus, the second pumping channel 256 has its inlet 260 disposed radially inwardly of the first pumping channel 252 and its outlet 262 disposed radially outwardly of the pumping channel 252. A curved transitional section 264 of the second pumping channel 256 crosses between the inlet 254 and outlet 258 of the first pumping channel 252. Preferably, the channels 252, 256 are separate and do not intersect or directly communicate with each other. Also preferably, the inlets 254, 260, of each pumping channel 252, 256 are disposed radially inwardly of their respective outlets 258, 262 and are desirably circumferentially spaced about 170° to 190° and preferably about 180° from each other. The outlets 258, 262 are preferably also spaced about 170° to 190° and preferably about 180° from each other. To remove fuel vapor from the liquid fuel in each pumping channel 252, 256, a vapor purge port 270, 272 (FIG. 10) may be provided in each channel 252, 256 adjacent the transition 264, 266.

Each pumping channel 252, 256 has what may be designated a low pressure section 274, 276 defined from its inlet 254, 260 to its transitional section 264, 266, respectively, and a high pressure section 278, 280 defined between its transitional section 264, 266 and its outlet 258, 262, respectively. In spite of this designation, in operation the fluid pressure in each pumping channel 254, 260 increases essentially continuously from the inlet to the outlet. Advantageously, the cross section area of the low pressure section 274, 276 of each channel gradually decreases downstream of its inlet 254, 260 and the high pressure section 278, 280 of each channel has a smaller cross-sectional area than its low pressure section 274, 276 to decrease the pressure drop at its inlet 254, 260 and to accommodate the decrease in fluid volume within the pumping channels 252, 256 due to the compression and condensation of fuel vapor and the discharge of fuel vapor through the vapor purge ports 270, 272. This decreasing of the cross sectional area of the low pressure sections 274, 276 and smaller cross-sectional area of the high. pressure sections 278, 280 may be implemented, for example, by forming these portions of the channels 252, 256 shallower and/or narrower.

Figure 13:
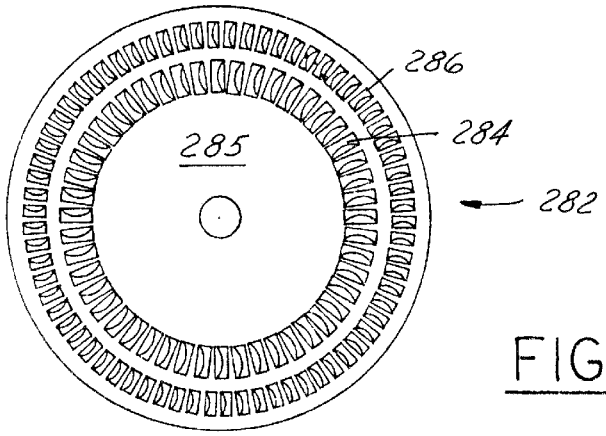
FIG. 13 is a bottom view of a rotor of the fuel pump of FIG. 9.

The rotor 282 has two circular sets of vanes 284, 286 formed in its lower face 285 to generate pressure within each channel 252, 256 as the rotor 282 rotates. The first set of vanes 284 is received radially inwardly of the second set of vanes 286. As best shown in FIG. 13 preferably, the first set of vanes 284 is disposed in a circular array and is constructed to cooperate with the low pressure sections 274, 276 of each channel 252, 256. The second set of vanes 286 is preferably also disposed in a circular array and is constructed to cooperate with the high pressure sections 278, 280 of each channel 252, 256. As shown in FIGS. 9 and 11–13 when the high pressure section 278, 280 of each pumping channel 252, 256 is narrower than its low pressure section 274, 276, the cooperating second set of vanes 286 is preferably correspondingly narrower than the first set of vanes 284. Alternatively, each channel 252, 256 may be of generally the same width and each set of vanes 284, 286 also may be of the same width to cooperate therewith in use. In this latter construction, the depth of the channels 252, 256 may be varied to accommodate the decrease in fluid volume downstream of the vapor purge ports 270, 272.

To further assist in balancing the forces acting on the rotor, preferably the rotor 282 also has at least one through port 288 communicating with a central annular groove or recess 290 in the stator. A bearing 294 for the motor armature shaft 292 is also press fit or molded in a recess 296 in the stator 12".

Figure 9:
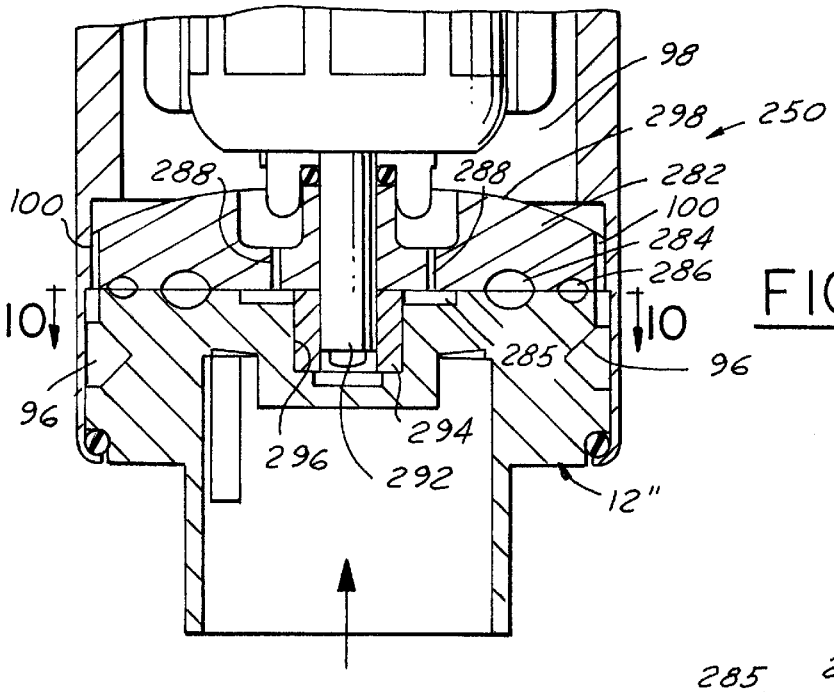
FIG. 9 is a fragmentary sectional view of a third fuel pump embodying the invention.
Figure 11:
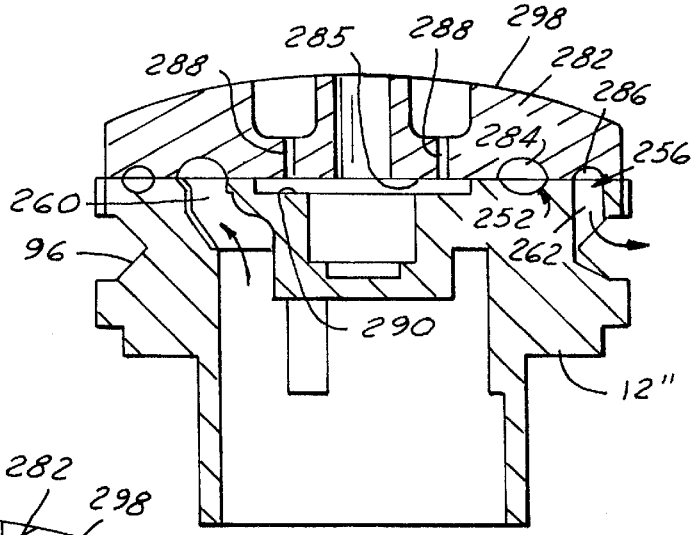
FIG. 11 is a sectional view taken generally along line 11—11 of FIG. 10.
Figure 12:
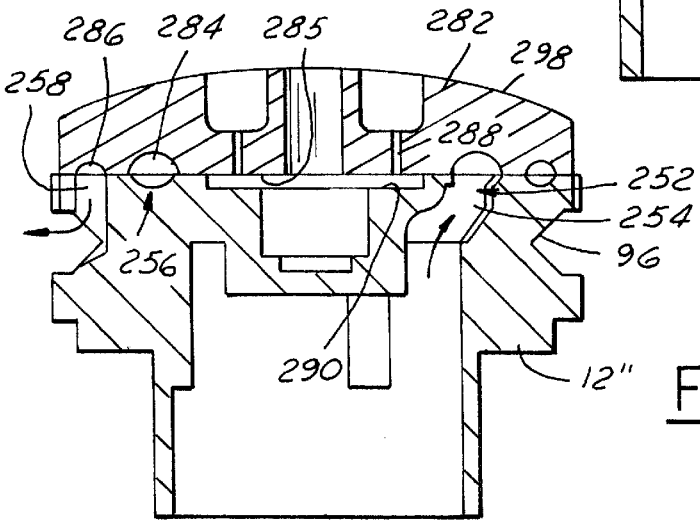
FIG. 12 is a sectional view taken generally along line 12—12 of FIG. 10.

In operation fuel pump 250 with the modified stator 12" draws fuel into the inlets 254, 260 of each channel 252, 256 at about 0 psi (for example), increases the pressure of fuel in each channel, and discharges fuel at about the outlet pressure of the fuel pump 250 from the outlet 258, 262 of each channel 252, 256. Thus, the fuel pump 250 has two separate, circumferentially offset but otherwise substantially identical fuel pumping channels 252, 256. As shown in FIG. 9 each outlet 258, 262 communicates with a peripheral groove 96 in the stator 12" which in turn communicates with chamber 98 through a clearance gap 100 as described with regard to the first embodiment fuel pump 10.

Desirably, the forces across the lower face 285 of the color 282 are generally uniformly distributed due to the circumferentially offset position of the channels 252, 256 with respect to one another and the substantially equal pressures generated in each channel 252, 256. To better balance the forces acting on the lower face 285 of the rotor 282, the high pressure section 280 of the second channel 256 is disposed generally adjacent to the low pressure section 274 of the first channel 252, and vice versa, with the high pressure section 278 of the first channel 252 disposed in the area of the low pressure section 276 of the second channel 256. Preferably the inlets 254, 260 of the channels are diametrically opposed or circumferentially spaced about 170° to 190° and preferably 180° apart and similarly so are the outlets 258, 262. In addition to balancing the forces across the lower face 285 of the rotor 282, the forces generated by the pressurized fuel in each channel 252, 256 oppose the force produced by the outlet fuel acting on the upper face 298 of the rotor 282 to reduce friction between the rotor 282 and the stator 12" and thereby increase the efficiency and extend the in service useful life of the fuel pump 250.

In all three embodiments of the fuel pump the surface area of the pumping channel or channels, any secondary channel and any recesses or cavities communicating with the secondary channel needed to balance the forces radially across and circumferentially around the rotor may be empirically determined such as by making prototypes with small pressure tap ports in the various areas to determine the pressure therein during operation of the pump and then changing the surface areas as needed to achieve the balance of the forces across and around the rotor. Based on data from these pressure tap ports a suitable computer model of the forces acting on the rotor during operation may also be developed to assist in achieving the desired balance of the forces across the rotor.

Figure 14:
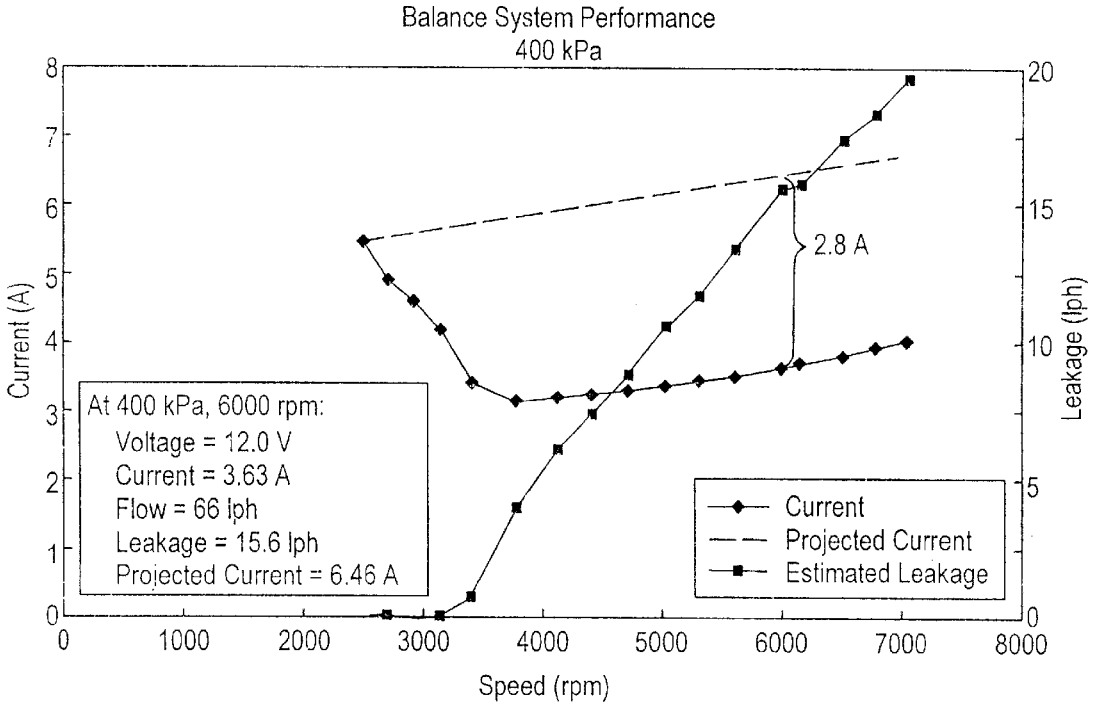
FIG. 14 is a plot of motor current and fuel pump leakage of an operating fuel pump assembly embodying the invention.

It will be appreciated that when the net total force tending to separate the rotor from the stator increases sufficiently a slight gap between them occurs which results in a slight fuel leakage. If this leakage becomes excessive the overall efficiency of the fuel pump assembly decreases. However, a slight leakage may be desirable to insure a "fluid bearing" between the mating surfaces of the opposed faces of the stator and rotor to minimize friction, wear and the power required to drive the rotor. The desired extent of this leakage can be determined by testing prototype pumps to determine the current drawn by the electric drive motor of the pump versus the leakage, as shown in FIG. 14, and optimizing the design to operate with some leakage and minimum or near minimum current draw at the desired output pressure and maximum flow rate or capacity. In FIG. 14 the graph of the "projected current" is the current that would be drawn by the electric drive motor if no leakage occurred.

What is claimed is:

1. An electric motor lateral channel fuel pump comprising:

a rotor driven to rotate by the motor and having a pair of generally opposed faces;

a stator;

a pumping channel between the rotor and the stator having an inlet and an outlet;

a first set of vanes in the rotor constructed to generate pressure within the pumping channel to increase the pressure of fuel in the pumping channel from the inlet to the outlet;

a second channel between the rotor and the stator and having an inlet and an outlet;

a second set of vanes in the rotor defining pockets communicating with only one face of the rotor and constructed to generate pressure within the second channel whereby the second channel provides a force applied to the rotor which is greater adjacent the inlet of the pumping channel than adjacent the outlet of the pumping channel to at least in part balance the force across the rotor applied to the rotor by the fuel in both the pumping channel and the second channel and to reduce the frictional forces between the rotor and stator as the rotor rotates.

2. The fuel pump of claim 1 wherein the pumping channel is disposed generally radially inwardly of the second channel.

3. The fuel pump of claim 1 wherein the pumping channel is disposed generally radially outwardly of the second channel.

4. The fuel pump of claim 1 wherein at least a portion of the pumping channel is disposed generally radially inwardly of the second channel and at least a portion of the pumping channel is disposed generally radially outwardly of the second channel.

5. The fuel pump of claim 1 which also comprises at least one cavity formed in the stator in communication with the second channel to receive liquid fuel under pressure therein and constructed and arranged to provide a force applied to the rotor to help balance the forces across the rotor.

6. The fuel pump of claim 5 wherein one cavity of said at least one cavity communicates with the second channel outlet and at least one other cavity is communicated with said one cavity through a calibrated slot to control the pressure in said at least one other cavity.

7. The fuel pump of claim 1 wherein the inlet of the second channel is circumferentially spaced from the pumping channel inlet.

8. The fuel pump of claim 7 wherein the inlet of the second channel is disposed generally midway between the pumping channel inlet and the pumping channel outlet.

9. The fuel pump of claim 1 wherein the pumping channel and second channel are generally circular and generally concentric with the axis of rotation of the rotor.

10. The fuel pump of claim 9 wherein the pumping channel spans approximately 330° to 350°.

11. The fuel pump of claim 9 wherein the second channel spans approximately 330° to 350°.

12. The fuel pump of claim 1 wherein the rotor has at least one inlet opening therethrough communicating liquid fuel downstream of the outlet of the pumping channel with the second channel.

13. The fuel pump of claim 12 wherein the at least one inlet opening in the rotor communicates with the inlet of the second channel which is disposed adjacent the axis of the rotor.

14. The fuel pump of claim 1 wherein the first and second set of vanes each comprise a plurality of individual vanes formed in a circular path in the rotor.

15. The fuel pump of claim 1 wherein the stator has a central cavity and the outlet of the pumping channel communicates with the central cavity.

16. The fuel pump of claim 1 wherein each vane of the first set of vanes is formed completely within one face of the rotor spaced generally radially inwardly from a periphery of said one face of the rotor.

17. The fuel pump of claim 1 wherein each vane of the second set of vanes is disposed radially inwardly of a periphery of said one face of the rotor.

18. The fuel pump of claim 1 wherein the pumping channel is disposed generally radially inwardly of an outer edge of the stator.

19. The fuel pump of claim 1 wherein the second channel is disposed generally radially inwardly of an outer edge of the stator.

20. An electric motor lateral channel fuel pump comprising:

a rotor driven to rotate by the motor;

a stator;

a first pumping channel between the rotor and the stator and having an inlet and an outlet;

a second pumping channel between the rotor and the stator and having an inlet, an outlet, a portion disposed radially inwardly of at least a portion of the first pumping channel and a portion disposed radially outwardly of at least a portion of the first pumping channel; and a first set of vanes in the rotor constructed to generate pressure within separate portions of the first and second pumping channels to increase the pressure of fuel in the first and second pumping channels;

a second set of vanes in the rotor constructed to communicate with and increase the pressure within separate portions of the first and second pumping channels whereby the second pumping channel provides a force applied to the rotor which is greater adjacent the inlet of the first pumping channel than adjacent the outlet of the first pumping channel to at least in part balance the force across the rotor applied to the rotor by the fuel in both the first pumping channel and the second pumping channel and to reduce the frictional forces between the rotor and stator as the rotor rotates.

21. The fuel pump of claim 20 wherein the second pumping channel has a transitional section which passes between the inlet and outlet of the first pumping channel.

22. The fuel pump of claim 21 wherein the first pumping channel has a portion disposed radially inwardly of a portion of the second channel and a portion disposed radially outwardly of a portion of the second channel and a transitional section which passes between the inlet and outlet of the second pumping channel such that the first pumping channel has a low pressure section between its inlet and its transitional section and which is positioned on the stator generally at substantially the same radius as the radius of the position of a low pressure section of the second pumping channel between its transitional section and its inlet.

23. The fuel pump of claim 22 wherein the first pumping channel has a high pressure section between its transitional section and its outlet which is positioned radially on the stator at substantially the same radius as the radius of the position of a high pressure section of the second pumping channel defined between its transitional section and its outlet.

24. The fuel pump of claim 22 wherein the inlet of the first pumping channel is disposed radially inwardly of the first pumping channel outlet and the inlet of the second pumping channel is disposed radially inwardly of the second pumping channel outlet.

25. The fuel pump of claim 23 wherein the first set of vanes is disposed in a circular array on the rotor and the second set of vanes is also disposed in a circular array on the rotor spaced radially outwardly of the first set of vanes.

26. The fuel pump of claim 25 wherein the second set of vanes communicates with the high pressure sections of both the first and second pumping channels and the first set of vanes communicates with the low pressure sections of both the first and second pumping channels.

27. The fuel pump of claim 23 wherein the low pressure sections of both the first and second pumping channels have a greater cross-sectional area than their corresponding high pressure sections.

28. The fuel pump of claim 27 which also comprises a pair of vapor purge ports each formed in a separate one of the first and second pumping channels upstream of the high pressure section of its respective pumping channel.

29. The fuel pump of claim 27 wherein the high pressure section of each of the first and second pumping channels is lower than the corresponding low pressure section of the corresponding pumping channel.

30. The fuel pump of claim 20 wherein both the first and second pumping channels are generally arcuate and span between 300 and 350 degrees.

31. The fuel pump of claim 20 wherein the inlet of the first pumping channel is circumferentially offset from the inlet of the second pumping channel by about 180 degrees.

32. The fuel pump of claim 20 wherein the outlet of the first pumping channel is circumferentially offset from the outlet of the second pumping channel by about 180 degrees.

* * * * *

UNITED STATES PATENT AND TRADEMARK OFFICE

CERTIFICATE OF CORRECTION

PATENT NO. : 6,162,012
DATED : December 19, 2000
INVENTOR(S) : Charles H. Tuckey and Edward J. Talaski It is certified that error appears in the above-identified patent and that said Letters Patent is hereby corrected as shown below:

Column 12,
Line 3, delete "lower" and insert -- narrower --.

Signed and Sealed this

Sixteenth Day of April, 2002

*Attest:*

*Attesting Officer*

JAMES E. ROGAN
*Director of the United States Patent and Trademark Office*